US009841711B2

(12) United States Patent
Kondo

(10) Patent No.: US 9,841,711 B2
(45) Date of Patent: Dec. 12, 2017

(54) IMAGE FORMING APPARATUS, STORAGE MEDIUM AND METHOD FOR CONTROLLING IMAGE FORMING APPARATUS

(71) Applicant: Brother Kogyo Kabushiki Kaisha, Nagoya-shi, Aichi-ken (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,757

(22) Filed: Jul. 29, 2016

(65) Prior Publication Data

US 2017/0031280 A1 Feb. 2, 2017

(30) Foreign Application Priority Data

Jul. 31, 2015 (JP) ..... 2015-152336

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/657* (2013.01); *G03G 2215/2035* (2013.01)

(58) Field of Classification Search
CPC ..... G03G 15/2039; G03G 15/205; G03G 15/657; G03G 2215/2035
USPC ..... 399/69, 68, 43, 44
See application file for complete search history.

(56) References Cited

U.S. PATENT DOCUMENTS 8,948,640 B2 2/2015 Takeuchi et al.
2007/0086817 A1* 4/2007 Kato ..... G03G 15/6564 399/388
2011/0142470 A1* 6/2011 Kim ..... G03G 15/2039 399/69
2013/0202324 A1* 8/2013 Takeuchi ..... G03G 15/2039 399/69
2016/0282778 A1* 9/2016 Suzuki ..... G03G 15/2039

FOREIGN PATENT DOCUMENTS

JP 2013-160980 A 8/2013

* cited by examiner

*Primary Examiner* — Sophia S Chen
(74) *Attorney, Agent, or Firm* — Banner & Witcoff, Ltd.

(57) ABSTRACT

An image forming apparatus includes a fixing device including a heater and a temperature sensor; a feeding roller configured to feed a recording sheet to the fixing device; and a controller. The controller is configured to: turn on the heater when the controller receives a printing command; cause the feeding roller to feed the recording sheet at a first timing, in a case where the controller determines that a temperature detected by the temperature sensor is equal to or greater than a first threshold temperature; cause the feeding roller to feed the recording sheet at a second timing later than the first timing, in a case where the controller determines that the detected temperature is smaller than the first threshold temperature; and selectively set the first threshold temperature to a first value or a second value smaller than the first value when the controller receives the printing command.

17 Claims, 9 Drawing Sheets

IMAGE FORMING APPARATUS, STORAGE MEDIUM AND METHOD FOR CONTROLLING IMAGE FORMING APPARATUS

CROSS-REFERENCE TO RELATED APPLICATIONS

This application claims priority from Japanese Patent Application No. 2015-152336 filed on Jul. 31, 2015, the entire contents of which are incorporated herein by reference.

TECHNICAL FIELD

The disclosure relates to an image forming apparatus including a fixing device including a heater, a storage medium storing a program that is to be executed by a computer configured to control the image forming apparatus, and a method for controlling an image forming apparatus.

BACKGROUND

In the related art, an image forming apparatus including a fixing device has been known which is configured to convey a recording sheet to the fixing device when the fixing device is at an appropriate temperature and to change supply timing of the recording sheet in accordance with the temperature of the fixing device so as to shorten time up to start of image formation.

For example, there is known an image forming apparatus having a control device configured to determine supply timing of the recording sheet. The control device is configured to set supply timing of a first recording sheet to a first timing on condition that a temperature gradient of the fixing device during predetermined time after a printing command is received is greater than a threshold value, and to set the supply timing of the first recording sheet to a second timing later than the first timing on condition that the temperature gradient is equal to or less than the threshold value. Also, the control device changes the threshold value to a smaller value when the temperature of the fixing device at the time of receiving the printing command is higher.

In the meantime, the time that is to be consumed until the fixing device at a cold state is heated to a fixable state changes depending on an output of a heater configured to heat the fixing device. For example, when a control of increasing the output of the heater is carried out at a state where the fixing device is cold, the heat is more likely to be transferred to the entire fixing device as compared to when a control of decreasing the output of the heater is carried out. As a result, the time that is to be consumed after the fixing device is heated until the fixing device becomes at a fixable state is shortened. For this reason, even when the temperature gradient of the fixing device during a predetermined time after the printing command is received is less than the threshold value, there are cases when the first recording sheet can be supplied at the first timing if the output of the heater is high.

SUMMARY

Aspects of the present disclosure provide an image forming apparatus capable of promptly starting supply of a recording sheet when a fixing device becomes at a fixable state while maintaining a fixing quality, a storage medium storing a program that is to be executed by a computer configured to control the image forming apparatus, and a method for controlling an image forming apparatus.

According to an aspect of the present disclosure, there is provided. An image forming apparatus including: a fixing device including a heater and a temperature sensor and configured to heat-fix developer on a recording sheet at a fixing region; a feeding roller configured to feed the recording sheet to the fixing device; and a controller, wherein the controller is configured to: turn on the heater when the controller receives a printing command; determine whether a temperature detected by the temperature sensor is equal to or greater than a first threshold temperature or smaller than the first threshold temperature when the controller receives the printing command; cause the feeding roller to feed the recording sheet at a first timing, in a case where the controller determines that the temperature detected by the temperature sensor is equal to or greater than the first threshold temperature; cause the feeding roller to feed the recording sheet at a second timing later than the first timing, in a case where the controller determines that the temperature detected by the temperature sensor is smaller than the first threshold temperature; and selectively set the first threshold temperature to a first value or a second value smaller than the first value when the controller receives the printing command.

According to another aspect of the present disclosure, there is provided a method for controlling an image forming apparatus including a fixing device including a heater and a temperature sensor and configured to heat-fix developer on a recording sheet at a fixing region and a feeding roller configured to feed the recording sheet to the fixing device, the method including: turning on the heater when a printing command is received; determining whether a temperature detected by the temperature sensor is equal to or greater than a first threshold temperature or smaller than the first threshold temperature when the printing command is received; causing the feeding roller to feed the recording sheet at a first timing, in a case where the controller determines that the temperature detected by the temperature sensor is equal to or greater than the first threshold temperature; causing the feeding roller to feed the recording sheet at a second timing later than the first timing, in a case where the controller determines that the temperature detected by the temperature sensor is smaller than the first threshold temperature; and selectively setting the first threshold temperature to a first value or a second value smaller than the first value when the printing command is received.

According to another aspect of the present disclosure, there is provided a non-transitory computer readable storage medium storing a program, when executed by a computer, cause an image forming apparatus to perform operations, the image forming apparatus including a fixing device including a heater and a temperature sensor and configured to heat-fix developer on a recording sheet at a fixing region and a feeding roller configured to feed the recording sheet to the fixing device, the operations including: turning on the heater when a printing command is received; determining whether a temperature detected by the temperature sensor is equal to or greater than a first threshold temperature or smaller than the first threshold temperature when the printing command is received; causing the feeding roller to feed the recording sheet at a first timing, in a case where the controller determines that the temperature detected by the temperature sensor is equal to or greater than the first threshold temperature; causing the feeding roller to feed the recording sheet at a second timing later than the first timing, in a case where the controller determines that the temperature detected by the temperature sensor is smaller than the first threshold temperature; and selectively setting the first threshold temperature to a first value or a second value smaller than the first value when the printing command is received.

Accordingly, by selectively setting the first threshold temperature to a first value or a second value smaller than the first value, it is possible to promptly start the supply of the recording sheet when the fixing device becomes at a fixable state while maintaining the fixing quality.

DETAILED DESCRIPTION

Hereinafter, an illustrative embodiment of the disclosure will be described in detail with reference to the drawings. In the following descriptions, a schematic configuration of a laser printer 1, which is an example of the image forming apparatus according to an illustrative embodiment of the disclosure, will be first described and features of the disclosure will be then described.

Figure 1:
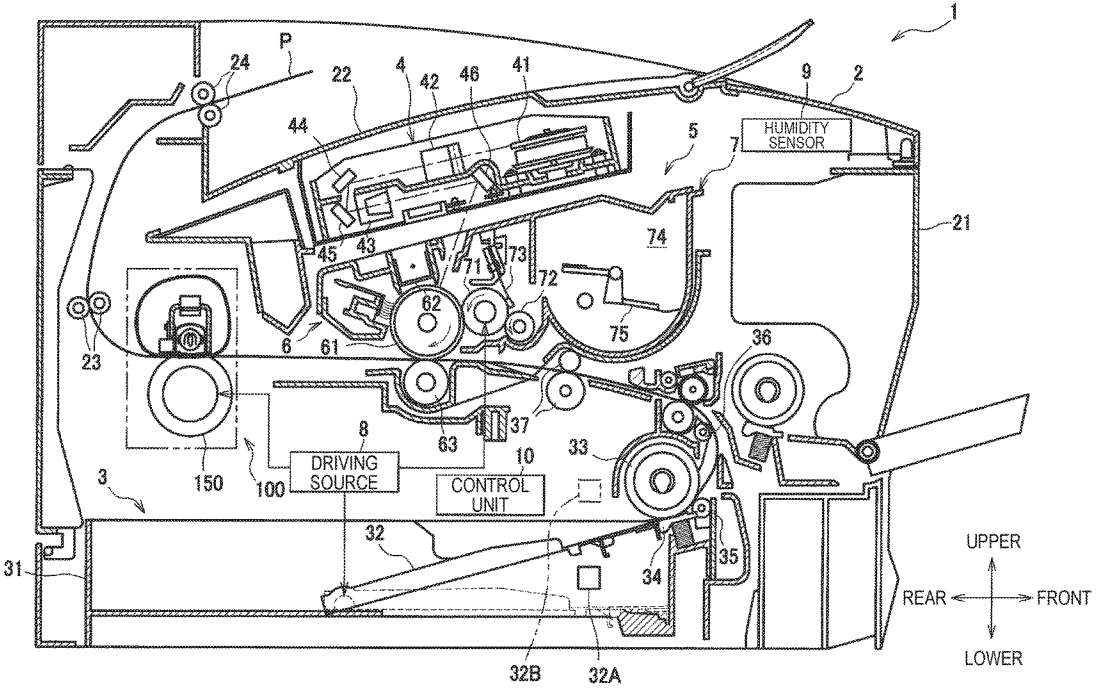
FIG. 1 depicts a schematic configuration of a laser printer according to an illustrative embodiment of the disclosure.

As shown in FIG. 1, the laser printer 1 mainly has, in a main body housing 2, a feeder unit 3 configured to supply a sheet P, which is an example of the recording sheet, an exposure device 4, a process cartridge 5 configured to form a toner image (developer image) on the sheet P, a fixing device 100 configured to heat-fix the toner image transferred to the sheet P, a driving source 8, a humidity sensor 9 and a control unit 10.

Meanwhile, in the following descriptions, the directions are described on the basis of a user who uses the laser printer. That is, the right side of FIG. 1 is referred to as 'front,' the left side is referred to as 'rear,' the front side is referred to as 'left' and the inner side is referred to as 'right.' Also, the upper and lower directions of FIG. 1 are referred to as 'upper-lower.'

The feeder unit 3 is provided at a lower part in the main body housing 2, and mainly has a sheet feeding tray 31 which accommodates therein the sheet P, a pressing plate 32 which is an example of the support plate, a pickup roller 33 which is an example of the feeding roller, a sheet feeding pad 34, paper dust pickup rollers 35, 36 and registration rollers 37.

The pickup roller 33 is disposed above a front end portion of the sheet feeding tray 31. The pickup roller 33 is configured to rotate with being in contact with the sheet P accommodated in the sheet feeding tray 31, thereby supplying the sheet P to the process cartridge 5.

The pressing plate 32 is provided for the sheet feeding tray 31 and is configured to support the sheet P accommodated in the sheet feeding tray 31. The pressing plate 32 is configured to bring a front end portion of the sheet P accommodated in the sheet feeding tray 31 close to the pickup roller 33. The pressing plate 32 is configured to rotate about a rear end portion, thereby moving between a spaced position (refer to the broken line), which is an example of the first position located at the lowest part and distant from the pickup roller 33, and a sheet feeding position (refer to the solid line), which is an example of the second position which the pressing plate reaches as it is rotated upward from the spaced position and at which the pressing plate is closer to the pickup roller 33 than at the spaced position and the sheet P is in contact with the pickup roller 33. In the meantime, the sheet feeding position is different depending on the number of the sheets P accommodated in the sheet feeding tray 31.

Also, the laser printer 1 has a pressing plate position sensor 32A configured to detect whether the pressing plate 32 is located at the spaced position or the sheet feeding position. For example, when the pressing plate 32 is located at a position above or below a predetermined position, the pressing plate position sensor 32A outputs different signals. Thereby, it is possible to detect whether the pressing plate 32 is located at the spaced position below the predetermined position or at the sheet feeding position above the predetermined position.

In the feeder unit 3, the sheets P in the sheet feeding tray 31 are inclined toward the pickup roller 33 by the pressing plate 32 and are separated one by one by the pickup roller 33 and the sheet feeding pad 34, which then passes through the paper dust pickup rollers 35, 36 and the registration rollers 37 and is conveyed toward the process cartridge 5.

The exposure device 4 is disposed at an upper part in the main body housing 2, and mainly has a laser light emitting unit (not shown), a polygon mirror 41 configured to rotate, lenses 42, 43, and reflectors 44, 45, 46. In the exposure device 4, a laser light (refer to the dashed-dotted line) emitted from the laser light emitting unit on the basis of image data is reflected on or passes through the polygon mirror 41, the lens 42, the reflectors 44, 45, the lens 43 and the reflector 46 in corresponding order and is then scanned on a surface of a photosensitive drum 61 at high speed.

The process cartridge 5 is disposed below the exposure device 4, and is configured to be detachably mounted to the main body housing 2 through an opening that is to be formed when a front cover 21 provided for the main body housing 2 is opened. The process cartridge 5 has a drum unit 6 and a developing unit 7.

The drum unit 6 mainly has a photosensitive drum 61, a charger 62 and a transfer roller 63. Also, the developing unit 7 is configured to be detachably mounted to the drum unit 6, and mainly has a developing roller 71, a supply roller 72, a layer thickness regulation blade 73, a toner accommodation unit 74 configured to accommodate therein toner (developer), and an agitator 75 configured to stir the toner in the toner accommodation unit 74 and to supply the same to the supply roller 72.

In the process cartridge 5, a surface of the photosensitive drum 61 is uniformly charged by the charger 62 and is then exposed by the high-speed scanning of the laser light from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73 and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Thereafter, the sheet P is conveyed between the photosensitive drum 61 and the transfer roller 63, so that the toner image on the photosensitive drum 61 is transferred to the sheet P.

The fixing device 100 is provided at the rear of the process cartridge 5. The fixing device 100 is configured to convey and heat the sheet P delivered from the process cartridge 5, thereby heat-fixing the toner image transferred to the sheet P on the sheet P. The sheet P of which the toner image has been heat-fixed by the fixing device 100 is discharged onto a sheet discharge tray 22 by conveying rollers 23, 24.

Figure 2:
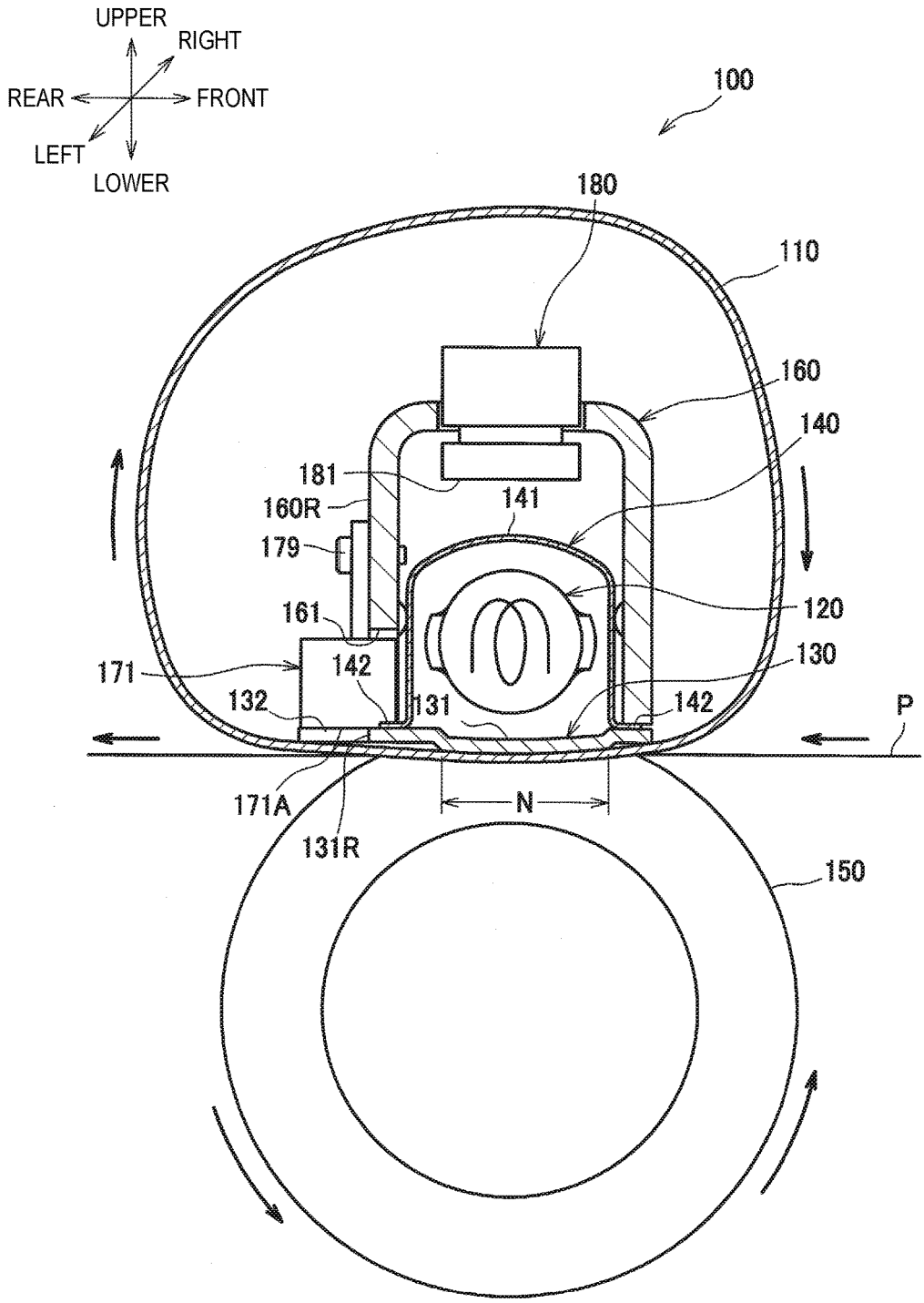
FIG. 2 is a sectional view of a fixing device.
Figure 3:
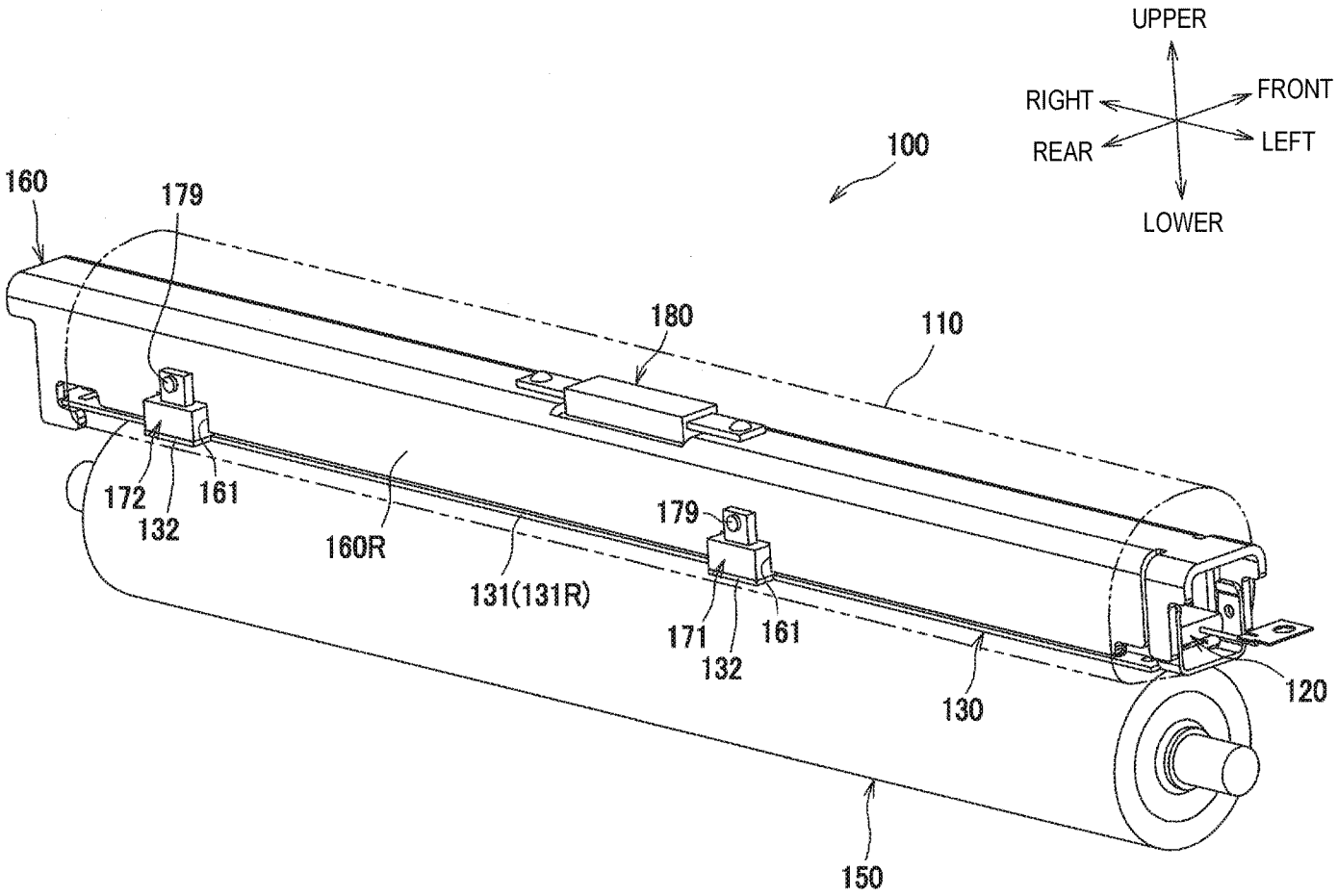
FIG. 3 is a perspective view of the fixing device.

As shown in FIGS. 2 and 3, the fixing device 110 mainly has a fixing belt 110, a heater 120, a nip plate 130, a reflection plate 140, a pressing roller 150, a stay 160, a first thermistor 171, which is an example of the temperature sensor, a second thermistor 172 and a thermostat 180.

The fixing belt 110 is an endless (cylindrical) member having heat resistance and flexibility, and both end portions in a width direction are rotation-guided by guide members (not shown).

The heater 120 is a halogen lamp, for example, and is configured to heat the fixing belt 110 (nip portion N) via the nip plate 130, thereby heating the toner on the sheet P. The heater 120 is disposed at a predetermined interval from inner surfaces of the fixing belt 110 and the nip plate 130, inside the fixing belt 110.

The nip plate 130 is a plate-shaped member configured to be applied with a pressing force from the pressing roller 150 and to transmit radiation heat from the heater 120 to the toner on the sheet P via the fixing belt 110, and is disposed so that a lower surface thereof is in sliding contact with the inner surface of the cylindrical fixing belt 110.

The nip plate 130 is made of an aluminum plate having a greater heat conductivity than the stay 160 made of steel (which will be described later), for example, and mainly has a substantially flat plate-shaped base part 131 and protrusions 132.

The protrusion 132 is formed to protrude rearward from a rear end portion 131R in a conveying direction of the base part 131 along the conveying direction. As shown in FIG. 3, the two protrusions 132 are provided in the vicinities of a right end and a center of the rear end portion 131R of the base part 131, respectively.

As shown in FIG. 2, the reflection plate 140 is a member configured to reflect the radiation heat from the heater 120 toward the nip plate 130 (an inner surface of the base part 131), and is disposed at a predetermined interval from the heater 120 inside the fixing belt 110 so as to surround the heater 120.

The reflection plate 140 is formed by bending an aluminum plate having great reflectivity of infrared and far infrared rays into a substantial U shape, as seen from a sectional view, for example. More specifically, the reflection plate 140 mainly has a reflection part 141 having a bent shape (a substantial U shape, as seen from a sectional view) and flange portions 142 extending from both end portions of the reflection part 141 along the conveying direction.

The pressing roller 150 is a member configured to sandwich the fixing belt 110 between the pressing roller and the nip plate 130 and to form a nip portion N between the pressing roller and the fixing belt 110, and is disposed below the nip plate 130. In the illustrative embodiment, the nip plate 130 is urged toward the pressing roller 150 so as to form the nip portion N. The pressing roller 150 is configured to rotate with sandwiching the fixing belt 110 between the pressing roller and the nip plate 130, thereby rotating together with the fixing belt 110 to convey rearward the sheet P. In the meantime, a configuration where the pressing roller 150 is urged toward the nip plate 130 so as to form the nip portion N may also be adopted.

The pressing roller 150 is configured to rotate, thereby rotating the fixing belt 110 by a frictional force with the fixing belt 110 (or the sheet P). The sheet P having the toner image transferred thereto is conveyed between the pressing roller 150 and the heated fixing belt 110 (the nip portion N), so that the toner image (toner) is heat-fixed.

The stay 160 is a member configured to support both end portions in a front-rear direction of the base part 131 of the nip plate 130 and to secure rigidity of the nip plate 130, has a substantial U shape conforming to the outer surface shape of the reflection part 141 of the reflection plate 140, as seen from a sectional view, and is disposed to cover the reflection plate 140. The stay 160 is formed by bending a steel plate having relatively high rigidity into a substantial U shape, as seen from a sectional view, for example. The stay 160 is configured to sandwich the flange portions 142 of the reflection plate 140 between the stay and the nip plate 130.

As shown in FIG. 3, a rear wall 160R of the stay 160 has two notches 161 for disposing the first thermistor 171 and the second thermistor 172. More specifically, the notches 161 are respectively formed to have a gap so as not to contact the first thermistor 171 and the second thermistor 172 at positions corresponding to the two protrusions 132 of the nip plate 130.

The first thermistor 171 and the second thermistor 172 are temperature sensors, and are disposed to detect a temperature of the fixing device 100, in the illustrative embodiment, a temperature of the nip plate 130. The first thermistor 171 is disposed in the vicinity of the center in the left-right direction of the nip plate 130 and is configured to detect a temperature of the nip plate 130 within a range in which the sheet P is to be conveyed. The second thermistor 172 is disposed at the right end portion of the nip plate 130, and is configured to detect a temperature beyond a range in which a small sheet P (for example, a postcard or an A6 sheet) is to be conveyed.

Also, as shown in FIGS. 2 and 3, the respective thermistors 171, 172 are fixed to the rear wall 160R of the stay 160 by screws 179 and are disposed to face upper surfaces (opposite surfaces to the sliding contact surfaces with the fixing belt 110) of the protrusions 132 of the nip plate 130, inside the fixing belt 110. The respective thermistors 171, 172 are disposed so that temperature detection surfaces 171A are in contact with the upper surfaces of the protrusion 132.

Also, the respective thermistors 171, 172 are disposed outside the reflection plate 140 with respect to the conveying direction. More specifically, the respective thermistors 171, 172 are disposed at a downstream side (rear side) of the reflection plate 140 with respect to the conveying direction, at an outer side of the nip portion N in the conveying direction. Also, the respective thermistors 171, 172 are disposed with a gap from the reflection plate 140 so that they are not in contact with an outer surface of the reflection plate 140.

The thermostat 180 is a temperature detection element using bimetal or the like, and is disposed to detect a temperature of the reflection plate 140. Specifically, the thermostat 180 is fixed to the stay 160 inside the fixing belt 110 (refer to FIG. 3), and is disposed above the reflection plate 140 so that a temperature detection surface 181 faces the reflection plate 140.

The thermostat 180 is provided on a circuit configured to feed power to the heater 120 and cuts off energization to the heater 120 when a predetermined temperature or higher is detected. Thereby, it is possible to prevent the temperature of the fixing device 100 from excessively increasing.

As shown in FIG. 1, the driving source 8 is configured to drive the pressing plate 32, the fixing device 100 and the developing unit 7. In the illustrative embodiment, the driving source 8 is configured to drive the pressing roller 150 of the fixing device 100. The driving source 8 includes a motor (not shown). Also, the laser printer 1 has a plurality of gear trains (not shown) configured to couple the developing unit 7 and the driving source 8. A driving force is transmitted to the developing unit 7 from the driving source 8, so that the developing roller 71, the supply roller 72 and the agitator 75 are rotated. That is, the driving source 8 is configured to drive the developing roller 71, the supply roller 72 and the agitator 75.

The humidity sensor 9 is a sensor configured to detect humidity in the main body housing 2, and is provided at an appropriate position in the main body housing 2.

Figure 4:
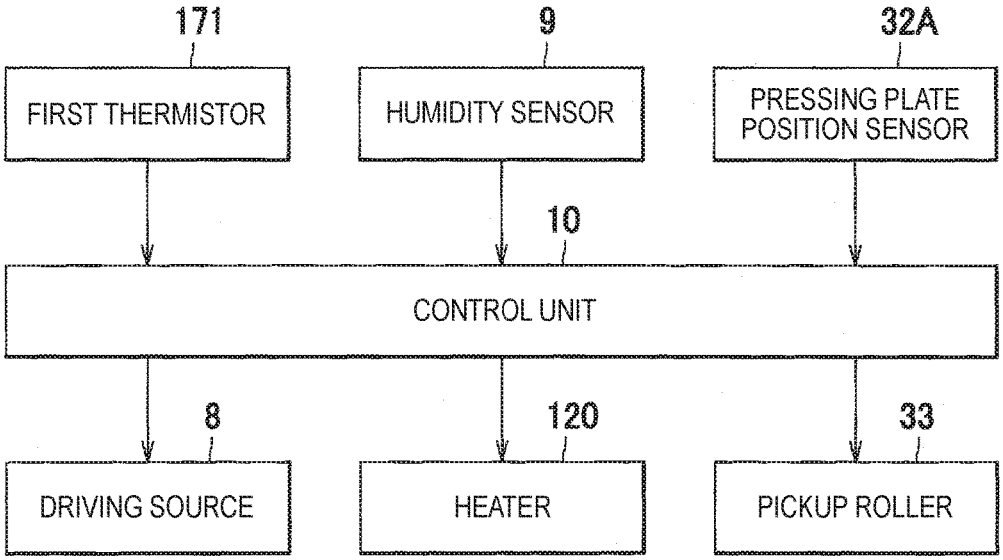
FIG. 4 is a block diagram depicting respective sensors, a control unit, a driving source, a heater and a pickup roller.

As shown in FIG. 4, the control unit 10 has a CPU, a ROM, a RAM and the like, and is configured to control the driving source 8, the heater 120 and the pickup roller 33 on the basis of a program prepared in advance and information acquired by the pressing plate position sensor 32A, the first thermistor 171 and the humidity sensor 9, thereby starting supply of the sheet P at predetermined timing when the fixing device 100 is at an appropriate temperature.

When a printing command is received, the control unit 10 turns on the heater 120 to start heating of the fixing device 100, sets a heater control instruction value so that the temperature of the fixing device 100 becomes a target temperature, based on the temperature T detected by the first thermistor 171, and adjusts an output of the heater 120. The heater control instruction value is a duty ratio indicative of an energization ratio per time, for example. The higher the heater control instruction value is, the output of the heater 120 becomes higher.

Also, the control unit 10 is configured to selectively execute a first output control in which the output of the heater 120 becomes a first output and a second output control in which the output of the heater 120 becomes a second output higher than the first output. Specifically, when the pressing plate 32 is located at the sheet feeding position at the time of receiving of the printing command, the control unit 10 executes the first output control in which an output of the driving source 8 is set to a third output M3 less than a maximum speed. When the pressing plate 32 is located at the spaced position at the time of receiving the printing command, the control unit 10 executes the second output control in which the output of the driving source 8 is set to a fourth output M4 (for example, maximum speed) greater than the third output M3 so as to promptly move the pressing plate 32 to the sheet feeding position. That is, the control unit 10 is configured to select the first output control and the second output control in accordance with the position of the pressing plate 32 at the time of receiving the printing command (selection processing).

When the first output control and the second output control are executed in this way and the second output control is thus carried out, the pressing roller 150 is rotated at higher speed, as compared to when the first output control is executed. When the pressing roller 150 is rotated, the heat of the nip plate 130 can be easily transmitted to the entire fixing device 100. Therefore, when the second output control in which the pressing roller 150 is rotated at higher speed is carried out, the heat of the nip plate 130 can be more easily transmitted, as compared to when the first output control is executed. As a result, the heater control instruction value is kept large, so that the output of the heater 120 increases.

Also, after the first output control and the second output control, when starting image formation, i.e., starting the supply of the sheet P, the control unit 10 sets the output of the driving source 8 to the fourth output M4.

At predetermined timing after starting the heating of the fixing device 100, in the illustrative embodiment, after second predetermined time B2 elapses from the turn-on of the heater 120, when a detected temperature $T_{B2}$ of the first thermistor 171 is equal to or greater than a first threshold value TH1, the control unit 10 executes a first supply control (first supply control execution processing) of supplying the first sheet P at first timing by the pickup roller 33. In the meantime, the timing at which the control unit 10 compares the temperature T detected by the first thermistor 171 and the first threshold value TH1 may be after predetermined time elapses from the reception of the printing command or after predetermined time elapses from the driving of the driving source 8. When the detected temperature $T_{B2}$ of the first thermistor 171 is less than the first threshold value TH1 after second predetermined time B2 elapses from the turn-on of the heater 120, the control unit 10 executes a second supply control (second supply control execution processing) of supplying the first sheet P at second timing later than the first timing by the pickup roller 33.

Specifically, the first timing is a point of time at which standby time t0 elapses after the heater 120 is turned on. That is, in the first supply control, when the standby time t0 elapses after starting the heating of the fixing device 110, the control unit 10 rotates the pickup roller 33 to supply the first sheet P. In the meantime, the first timing may be a point of time at which the standby time t0 elapses after the printing command is received or may be a point of time at which the standby time t0 elapses after the driving source 8 is driven. Also, the second timing is a point of time at which the temperature T detected by the first thermistor 171 reaches a predetermined temperature TH3 after the heater 120 is turned on. That is, in the second supply control, when the temperature T detected by the first thermistor 171 reaches the predetermined temperature TH3 after starting the heating of the fixing device 100, the control unit 10 rotates the pickup roller 33 to supply the first sheet P. In the meantime, the standby time t0 is set to the shortest time during which the fixing device 100 becomes at an appropriate temperature until the supplied first sheet P reaches the fixing device 100. Also, the predetermined temperature TH3 is set to the lowest temperature at which the fixing device 100 becomes at an appropriate temperature until the supplied first sheet P reaches the fixing device 100.

Also, in the second supply control, after the second predetermined time B2 from the turn-on of the heater 120, when the detected temperature $T_{B2}$ of the first thermistor 171 is less than a second threshold value TH2 smaller than the first threshold value TH1, the control unit 10 sets the predetermined temperature TH3 to a lower value, as compared to when the detected temperature $T_{B2}$ of the first thermistor 171 is equal to or greater than the second threshold value TH2. Specifically, after the second predetermined time B2 from the turn-on of the heater 120, when the detected temperature $T_{B2}$ of the first thermistor 171 is equal to or greater than the second threshold value TH2, the control unit 10 sets the predetermined temperature TH3 to a first predetermined temperature T1, and when the detected temperature $T_{B2}$ of the first thermistor 171 is less than the second threshold value TH2, the control unit 10 sets the predetermined temperature TH3 to a second predetermined temperature T2 lower than the first predetermined temperature T1.

In the meantime, the control unit 10 is configured to control a motor, which is configured to drive the pickup roller 33 provided separately from the driving source 8, thereby controlling rotation/stop of the pickup roller 33. The control of the rotation/stop of the pickup roller 33 by the control unit 10 is not limited thereto. For example, the control unit may be configured to control a solenoid actuator configured to vertically drive the pickup roller 33, or the like. Also, the laser printer 1 may have a driving transmission mechanism capable of switching between a connection state where the driving force of the driving source 8 can be transmitted to the pickup roller 33 and a disconnection state where the driving force of the driving source 8 is cut off, and the control unit 10 may be configured to control the driving transmission mechanism, thereby controlling the rotation/stop of the pickup roller 33.

The control unit 10 is configured to set the first threshold value TH1, which is to be used when executing the second output control, to a value less than the first threshold value TH1, which is to be used when executing the first output control (first threshold value setting processing).

Also, the control unit 10 is configured to set the first threshold value TH1, which is to be used when a humidity detected by the humidity sensor 9 is equal to or greater than a predetermined humidity, to a value greater than the first threshold value TH1, which is to be used when the humidity detected by the humidity sensor 9 is less than the predetermined humidity.

When a first temperature detected by the first thermistor 171 after first predetermined time B1 from the turn-on of the heater 120, i.e., from the start of the heating of the fixing device 100 is higher than a second temperature detected by the first thermistor 171 after second predetermined time B2 longer than the first predetermined time B1 from the start of the heating of the fixing device 100, the control unit 10 sets the first threshold value TH1 to a value smaller than the first threshold value TH1 that is to be used when the first temperature is equal to or lower than the second temperature. More specifically, when the maximum value Tmax of the temperature T detected by the first thermistor 171 after the heating of the fixing device 100 starts until the second predetermined time B2 elapses is greater than the detected temperature $T_{B2}$ of the first thermistor 171 after the second predetermined time B2 from the start of the heating of the fixing device 100, the control unit 10 sets the first threshold value TH to a value smaller than the first threshold value TH1 that is to be used when the maximum value Tmax of the temperature T detected by the first thermistor 171 after the heating of the fixing device 110 starts until the second predetermined time B2 elapses is the same as the detected temperature $T_{B2}$ of the first thermistor 171 after the second predetermined time B2 from the start of the heating of the fixing device 100.

Figure 9:
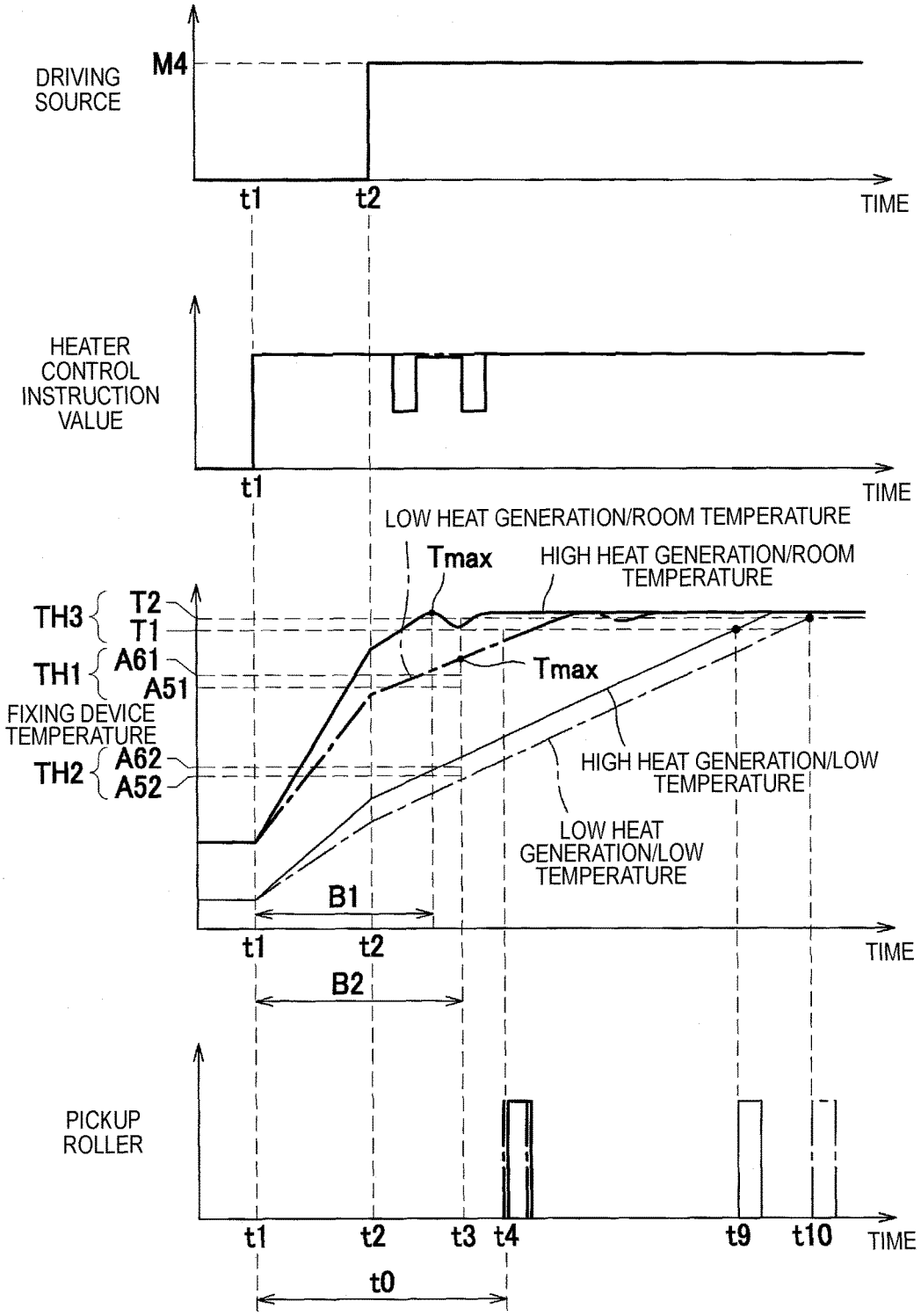
FIG. 9 is a timing chart depicting a difference of the sheet feeding timings depending on states of a heater.

Herein, a difference of the temperature increase rate of the fixing device 100 is described. The timing at which the temperature T detected by the first thermistor 171 after the heater 120 is turned on until the second predetermined time B2 elapses becomes the maximum value Tmax is different depending on the temperature of the fixing device 100 or a heat generation state of the heater 120 upon the turn-on of the heater 120. For example, the heat generation state of the heater 120 changes due to manufacturing non-uniformity of the output of the heater 120 or non-uniformity of a power supply voltage. For this reason, when the heat generation state of the heater 120 is favorable, the temperature T detected by the first thermistor 171 is more likely to increase, as compared to when the heat generation state of the heater 120 is poor, as shown in FIG. 9. In a case where the heat generation state of the heater 120 is favorable and the laser printer 1 is used under environments of room temperature or higher, when the first predetermined time B1 elapses before the second predetermined time B2 elapses after the heater 120 is turned on, the temperature T detected by the first thermistor 171 becomes the maximum value Tmax. When the temperature T detected by the first thermistor 171 becomes the maximum value Tmax, the control unit 10 decreases the heater control instruction value. Thereby, at the point of time at which the second predetermined time B2 elapses after the heater 120 is turned on, the detected temperature $T_{B2}$ becomes less than the maximum value Tmax. On the other hand, when the heat generation state of the heater 120 is poor or the laser printer 1 is used under low temperature environments, the control unit 10 keeps the heater control instruction value high. At the point of time at which the second predetermined time B2 elapses after the heater 120 is turned on, the detected temperature $T_{B2}$ of the first thermistor 171 becomes the maximum value Tmax of the temperature T detected by the first thermistor 171 after the heater 120 is turned on until the second predetermined time B2 elapses. That is, when the temperature T detected by the first thermistor 171 becomes the maximum value Tmax before the second predetermined time B2 elapses after the heater 120 is turned on, it is possible to set the first threshold value TH1 to the slight small value because the heat generation state of the heater 120 is favorable and the fixing device 100 is sufficiently warmed.

Like the first threshold value TH1 as described above, the control unit 10 is configured to set the second threshold value TH2 depending on the respective conditions. That is, the control unit 10 is configured to set the second threshold value TH2, which is to be used when executing the second output control, to a value smaller than the second threshold value TH2, which is to be used when executing the first output control. Also, the control unit 10 is configured to set the second threshold value TH2, which is to be used when the humidity detected by the humidity sensor 9 is equal to or greater than the predetermined humidity, to a value greater than the second threshold value TH2, which is to be used when the humidity detected by the humidity sensor 9 is less than the predetermined humidity. When the first temperature detected by the first thermistor 171 after the first predetermined time B1 from the turn-on of the heater 120 is higher than the second temperature detected by the first thermistor 171 after the second predetermined time B2 longer than the first predetermined time B1 from the start of the heating of the fixing device 100, the control unit 10 sets the second threshold value TH2 to a value smaller than the second threshold value TH2, which is to be used when the first temperature is equal to or lower than the second temperature.

In order to set the first threshold value TH1 and the second threshold value TH2 as described above, the control unit 10 is configured to store therein a map, which indicates values of the first threshold value TH1 and the second threshold value TH2 corresponding to combinations of respective states (a position of the pressing plate 32 at the time of receiving the printing command, the humidity, and the difference of the temperature increase rate of the fixing device 100). The control unit 10 is configured to acquire the first threshold value TH1 and the second threshold value TH2 by referring to the map.

Subsequently, a specific control operation of the control unit 10 is described.

Figure 5:
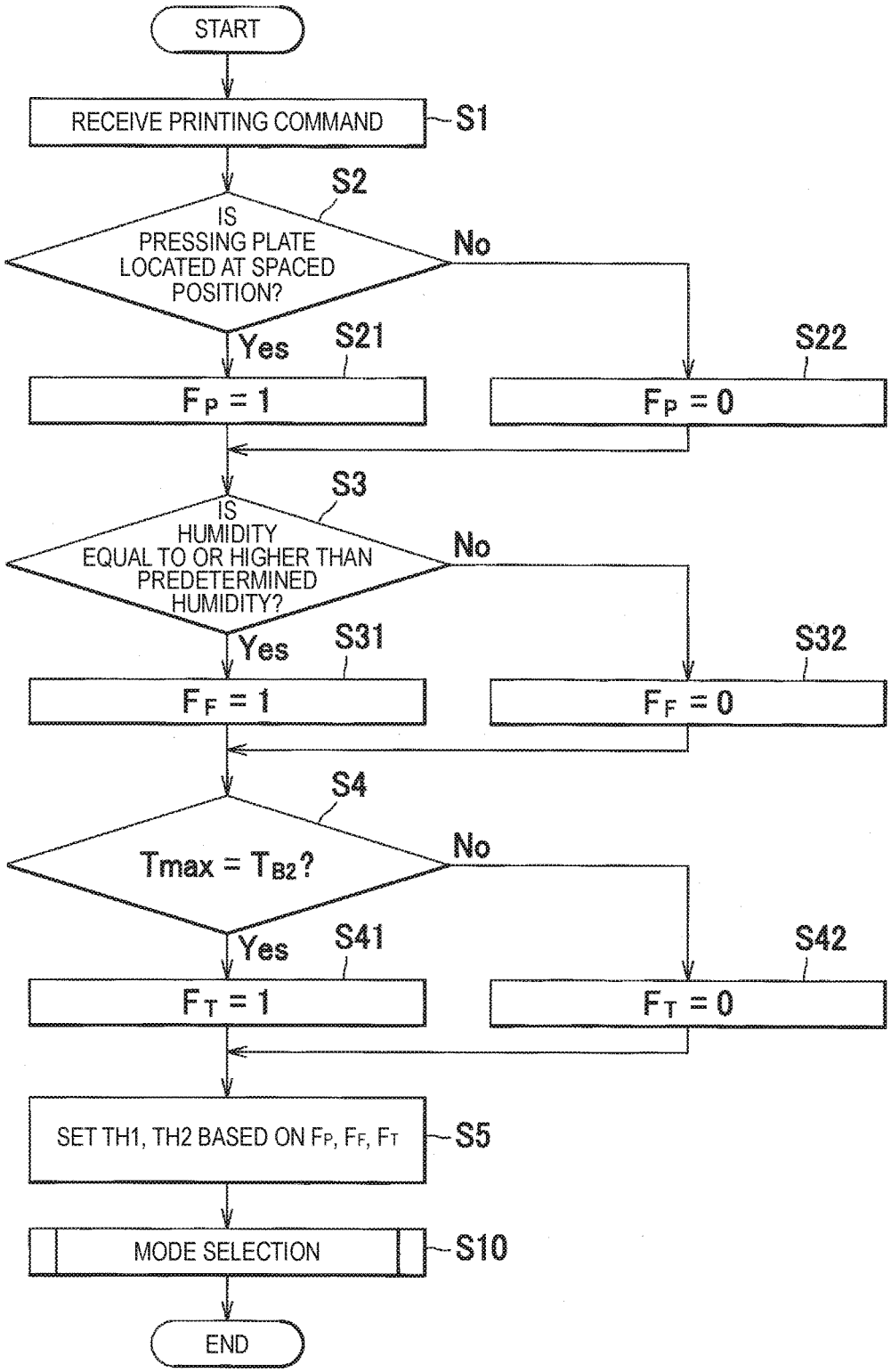
FIG. 5 is a flowchart depicting a control operation of the control unit.

As shown in FIG. 5, when the printing command is received (S1), the control unit 10 determines whether the pressing plate 32 is located at the spaced position (S2).

When it is determined in step S2 that the pressing plate 32 is located at the spaced position (S2, Yes), the control unit 10 sets a pressing plate flag $F_P$ to 1 (S21). On the other hand, when it is determined in step S2 that the pressing plate 32 is not located at the spaced position (S2, No), the control unit 10 sets the pressing plate flag $F_P$ to zero (0) (S22).

When the pressing plate flag $F_P$ is set in step S21 or step S22, the control unit 10 determines whether the humidity is equal to or greater than the predetermined humidity from a detection result of the humidity sensor 9 (S3).

When it is determined in step S3 that the humidity is equal to or greater than the predetermined humidity (S3, Yes), the control unit 10 sets a humidity flag $F_F$ to 1 (S31). On the other hand, when it is determined in step S3 that the humidity is less than the predetermined humidity (S3, No), the control unit 10 sets the humidity flag $F_F$ to zero (0) (S32).

When the humidity flag $F_F$ is set in step S31 or step S32, the control unit 10 determines whether the maximum value Tmax of the temperature T detected by the first thermistor 171 is the detected temperature $T_{B2}$ of the first thermistor 171 after the second predetermined time B2 from the start of the heating of the fixing device 100 (S4).

When it is determined in step S4 that the maximum value Tmax of the temperature T detected by the first thermistor 171 is the detected temperature $T_{B2}$ after the second predetermined time B2 from the start of the heating of the fixing device 100 (S4, Yes), the control unit 10 sets a temperature flag $F_T$ to 1 (S41). On the other hand, when it is determined in step S4 that the maximum value Tmax of the temperature T detected by the first thermistor 171 is not the detected temperature $T_{B2}$ after the second predetermined time B2 from the start of the heating of the fixing device 100 (S4, No), the control unit 10 sets the temperature flag $F_T$ to zero (0) (S42).

When the temperature flag $F_T$ is set in step S41 or step S42, the control unit 10 refers to the map to set the values of the first threshold value TH1 and the second threshold value TH2 based on the pressing plate flag $F_P$, the humidity flag $F_F$ and the temperature flag $F_T$ (S5). Then, the control unit 10 executes mode selection (S10), and ends the control.

Figure 6:
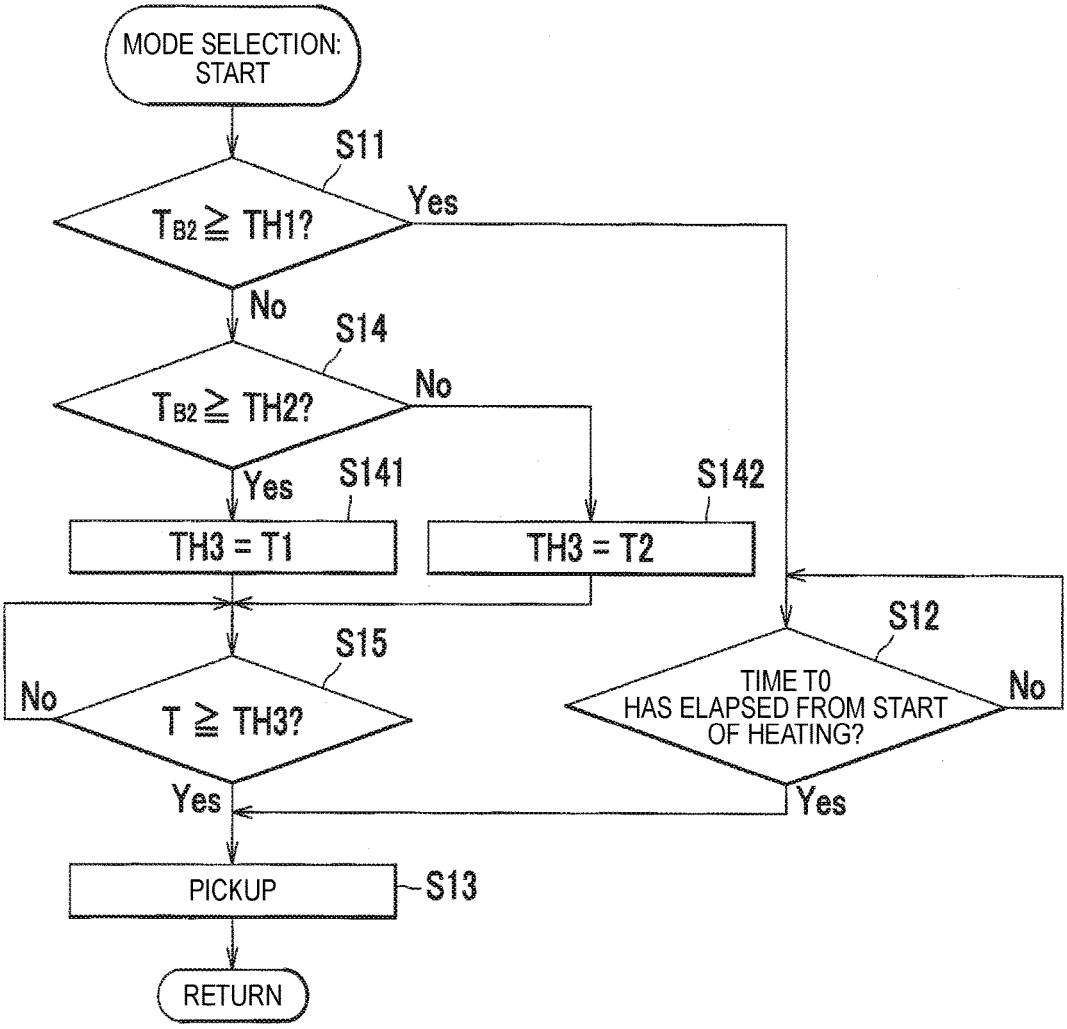
FIG. 6 is a flowchart depicting a control operation of mode selection control.

As shown in FIG. 6, when the control unit 10 starts the mode selection, the control unit 10 determines whether the detected temperature $T_{B2}$ of the first thermistor 171 after the second predetermined time B2 from the start of the heating of the fixing device 100 is equal to or greater than the first threshold value TH1 (S11).

When it is determined in step S11 that the detected temperature $T_{B2}$ of the first thermistor 171 after the second predetermined time B2 from the start of the heating of the fixing device 100 is equal to or greater than the first threshold value TH1 (S11, Yes), the control unit 10 determines whether the standby time t0 has elapsed from the start of the heating of the fixing device 100 (S12). When it is determined in step S12 that the standby time to has not elapsed from the start of the heating of the fixing device 100 (S12, No), the control unit 10 stands by until the standby time t0 elapses from the start of the heating of the fixing device 100. When it is determined in step S12 that the standby time t0 has elapsed from the start of the heating of the fixing device 100 (S12, Yes), the control unit 10 rotates the pickup roller 33 to pick up the first sheet P (S13).

When it is determined in step S11 that the detected temperature $T_{B2}$ of the first thermistor 171 after the second predetermined time B2 from the start of the heating of the fixing device 100 is not equal to or greater than the first threshold value TH1 (S11, No), the control unit 10 determines whether the detected temperature $T_{B2}$ of the first thermistor 171 after the second predetermined time B2 from the start of the heating of the fixing device 100 is equal to or greater than the second threshold value TH2 (S14).

When it is determined in step S14 that the detected temperature $T_{B2}$ of the first thermistor 171 after the second predetermined time B2 from the start of the heating of the fixing device 100 is equal to or greater than the second threshold value TH2 (S14, Yes), the control unit 10 sets the predetermined temperature TH3 to the first predetermined temperature T1 (S141). On the other hand, when it is determined in step S14 that the detected temperature $T_{B2}$ of the first thermistor 171 after the second predetermined time B2 from the start of the heating of the fixing device 100 is not equal to or greater than the second threshold value TH2 (S14, No), the control unit 10 sets the predetermined temperature TH3 to the second predetermined temperature T2 lower than the first predetermined temperature T1 (S142).

When the value of the predetermined temperature TH3 is set in step S141 or step S142, the control unit 10 determines whether the temperature T detected by the first thermistor 171 is equal to or greater than the predetermined temperature TH3 (S15).

When it is determined in step S15 that the temperature T detected by the first thermistor 171 is not equal to or greater than the predetermined temperature TH3 (S15, No), the control unit 10 stands by until the temperature T detected by the first thermistor 171 becomes equal to or greater than the predetermined temperature TH3. When it is determined in step S15 that the temperature T detected by the first thermistor 171 is equal to or greater than the predetermined temperature TH3 (S15, Yes), the control unit 10 proceeds to step S13 and rotates the pickup roller 33 to pick up the first sheet P.

After picking up the first sheet P in step S13, the control unit 10 ends the mode selection.

Subsequently, operations of the laser printer 1 are described.

First, a case where the position of the pressing plate 32 is different is described with reference to FIG. 7. Meanwhile, regarding the respective conditions shown in FIG. 7, it is assumed that the humidity is the same and the heat generation state of the heater 120 is poor.

When the pressing plate 32 is located at the spaced position (refer to the solid line) at the time that the control unit 10 receives the printing command, the control unit 10 sets the output of the driving source 8 to the fourth output M4 and turns on the heater 120 (time t1). Also, when the pressing plate 32 is located at the sheet feeding position (refer to the broken line) at the time that the control unit 10 receives the printing command, the control unit 10 sets the output of the driving source 8 to the third output M3 and turns on the heater 120 (time t1). When the heater 120 is turned on in this way, the temperature T detected by the first thermistor 171 starts to increase.

After the heater 120 is turned on, the control unit 10 turns on the driving source 8 with the set output (time t2). Thereby, the pressing roller 150 of the fixing device 100 rotates. When the pressing plate 32 is located at the spaced position at the time of receiving the printing command, since the output of the driving source 8 is higher, as compared to when the pressing plate 32 is located at the sheet feeding position, the pressing roller 150 rotates fast, so that the heat of the nip plate 130 is promptly spread over the entire fixing device 100. Thereby, the temperature T detected by the first thermistor 171 more gently increases when the pressing plate 32 is located at the spaced position, as compared to when the pressing plate 32 is located at the sheet feeding position. For this reason, the control unit 10 keeps the heater control instruction value higher when the pressing plate 32 is located at the spaced position, as compared to when the pressing plate 32 is located at the sheet feeding position, so that the output of the heater 120 increases.

When the second predetermined time B2 elapses (time t3) after the heater 120 is turned on, the control unit 10 sets the first threshold value TH1 to a temperature A11 and the second threshold value TH2 to a temperature A12 if the pressing plate 32 is located at the spaced position at the time of receiving the printing command. On the other hand, if the pressing plate 32 is located at the sheet feeding position at the time of receiving the printing command, the control unit 10 sets the first threshold value TH1 to a temperature A21 higher than the temperature A11 and the second threshold value TH2 to a temperature A22 higher than the temperature A12.

At this time, if the detected temperature TB2 of the first thermistor 171 is equal to or greater than the first threshold value TH1, when the standby time t0 elapses (time t4) from the turn-on of the heater 120, the pickup roller 33 rotates to pick up the first sheet P (refer to the bold solid line and the bold dashed-dotted line).

Herein, when the pressing plate 32 is located at the spaced position at the time of receiving the printing command, the pressing roller 150 rotates fast and the output of the heater 120 is high. Therefore, even when the detected temperature $T_{B2}$ of the first thermistor 171 after the second predetermined time B2 from the turn-on of the heater 120 is a value smaller than the temperature A21, there is a possibility that the fixing device 100 becomes at an appropriate temperature at which the sheet feeding starts after the standby time to elapses from the turn-on of the heater 120. For this reason, when the pressing plate 32 is located at the spaced position at the time of receiving the printing command, the first threshold value TH1 is set to the temperature A11 lower than the temperature A12, which is the first threshold value TH to be used when the pressing plate 32 is located the sheet feeding position, so that it is possible to promptly start to feed the sheet at appropriate timing at a condition by which the fixing device 100 becomes at an appropriate temperature after the standby time t0 from the turn-on of the heater 120.

Figure 7:
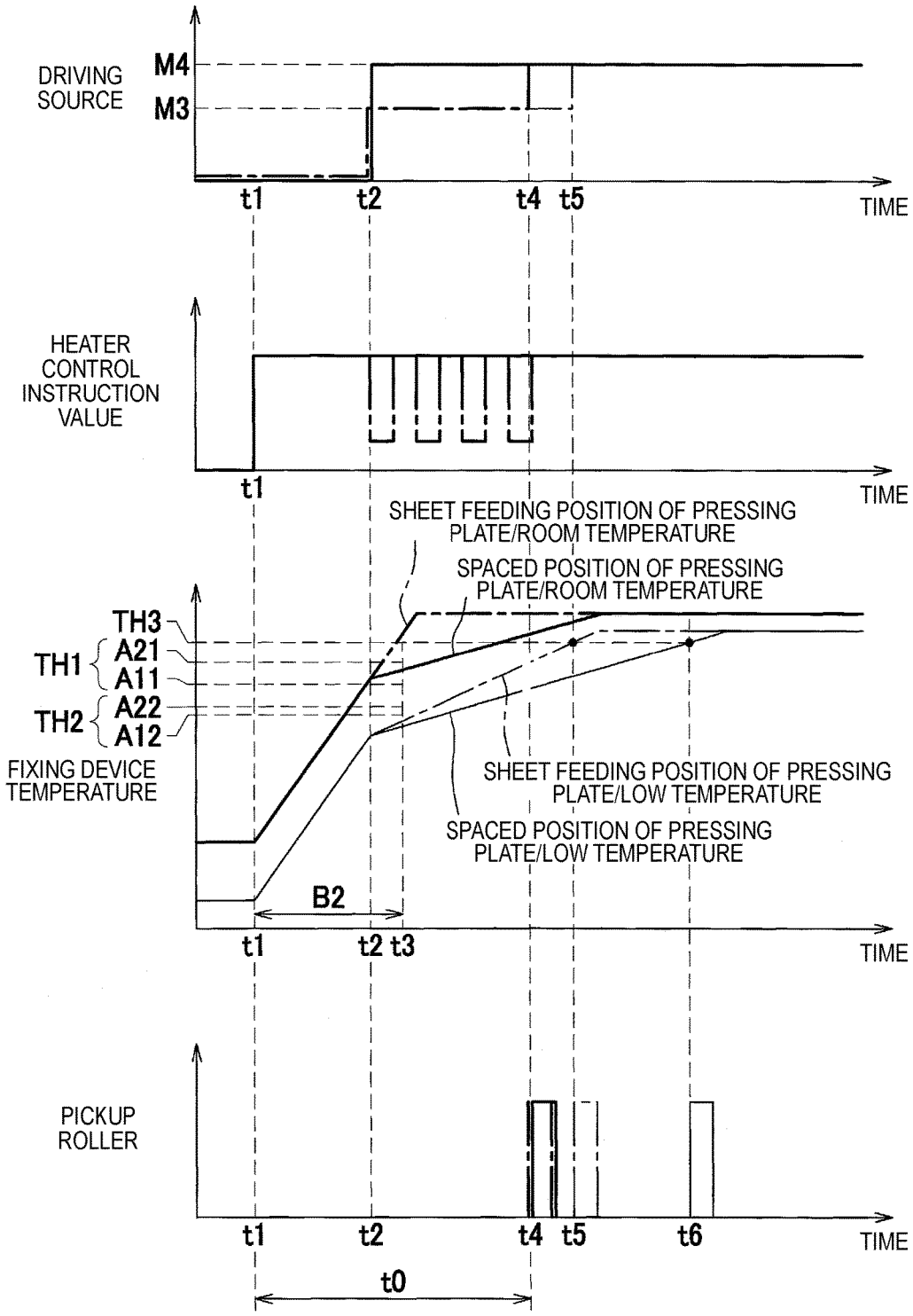
FIG. 7 is a timing chart depicting a difference of sheet feeding timings depending on positions of a pressing plate.

However, as shown with the thin solid line and dashed-dotted line in FIG. 7, when the laser printer 1 is under low temperature environments and the temperature T detected by the first thermistor 171 at the time of receiving the printing command is low, the detected temperature $T_{B2}$ of the first thermistor 171 after the second predetermined time B2 from the turn-on of the heater 120 becomes smaller than the first threshold value TH1 and the second threshold value TH2. In this case, when the temperature T detected by the first thermistor 171 becomes equal to or higher than the predetermined temperature TH3, the pickup roller 33 rotates to pick up the first sheet P (time t5 and time t6). Like this, if the temperature of the fixing device 100 at the time of receiving the printing command is low, since the sheet feeding starts when the temperature of the fixing device 100 sufficiently increases, it is possible to promptly start the sheet feeding when the fixing device 100 becomes at an appropriate temperature.

Subsequently, a case where the humidity is different is described with reference to FIG. 8. Meanwhile, regarding the respective conditions shown in FIG. 8, it is assumed that the pressing plate 32 is located at the spaced position at the time of receiving the printing command and the heat generation state of the heater 120 is poor.

When the printing command is received and the heater 120 is thus turned on (time t1), the temperature T detected by the first thermistor 171 starts to increase. At this time, when the humidity is high (refer to the dashed-dotted line), since the sheet P absorbs the moisture, the temperature T detected by the first thermistor 171 more gently increases, as compared to when the humidity is low (refer to the solid line). Thereby, when the humidity is high, since the control unit 10 keeps the heater control instruction value large, the output of the heater 120 is higher when the humidity is high, as compared to when the humidity is low.

After the second predetermined time B2 elapses from the turn-on of the heater 120, when the humidity is less than a predetermined humidity (low humidity), the control unit 10 sets the first threshold value TH1 to a temperature A31 and the second threshold value TH2 to a temperature A32. Also, after the second predetermined time B2 elapses from the turn-on of the heater 120, when the humidity is equal to or higher than the predetermined humidity (high humidity), the control unit 10 sets the first threshold value TH1 to a temperature A41 higher than the temperature A31 and the second threshold value TH2 to a temperature A42 higher than the temperature A32.

At this time, when the detected temperature $T_{B2}$ of the first thermistor 171 is equal to or greater than the first threshold value TH1 (refer to the bold solid line and dashed-dotted line), the pickup roller 33 rotates to pick up the first sheet P (time t4) after the standby time to elapses from the turn-on of the heater 120.

Herein, when the humidity is equal to or greater than the predetermined humidity, the output of the heater 120 is high. Therefore, even when the detected temperature $T_{B2}$ of the first thermistor 171 after the second predetermined time B2 from the turn-on of the heater 120 is a value smaller than the temperature A41, there is a possibility that the fixing device 100 becomes at an appropriate temperature after the standby time t0 elapses from the turn-on of the heater 120. For this reason, when the humidity is equal to or greater than the predetermined humidity, the first threshold value TH1 is set to the temperature A31 lower than the temperature A41, which is the first threshold value TH1 to be used when the humidity is less than the predetermined humidity, so that it is possible to promptly start to feed the sheet at appropriate timing at a condition by which the fixing device 100 becomes at an appropriate temperature after the standby time t0 from the turn-on of the heater 120.

Figure 8:
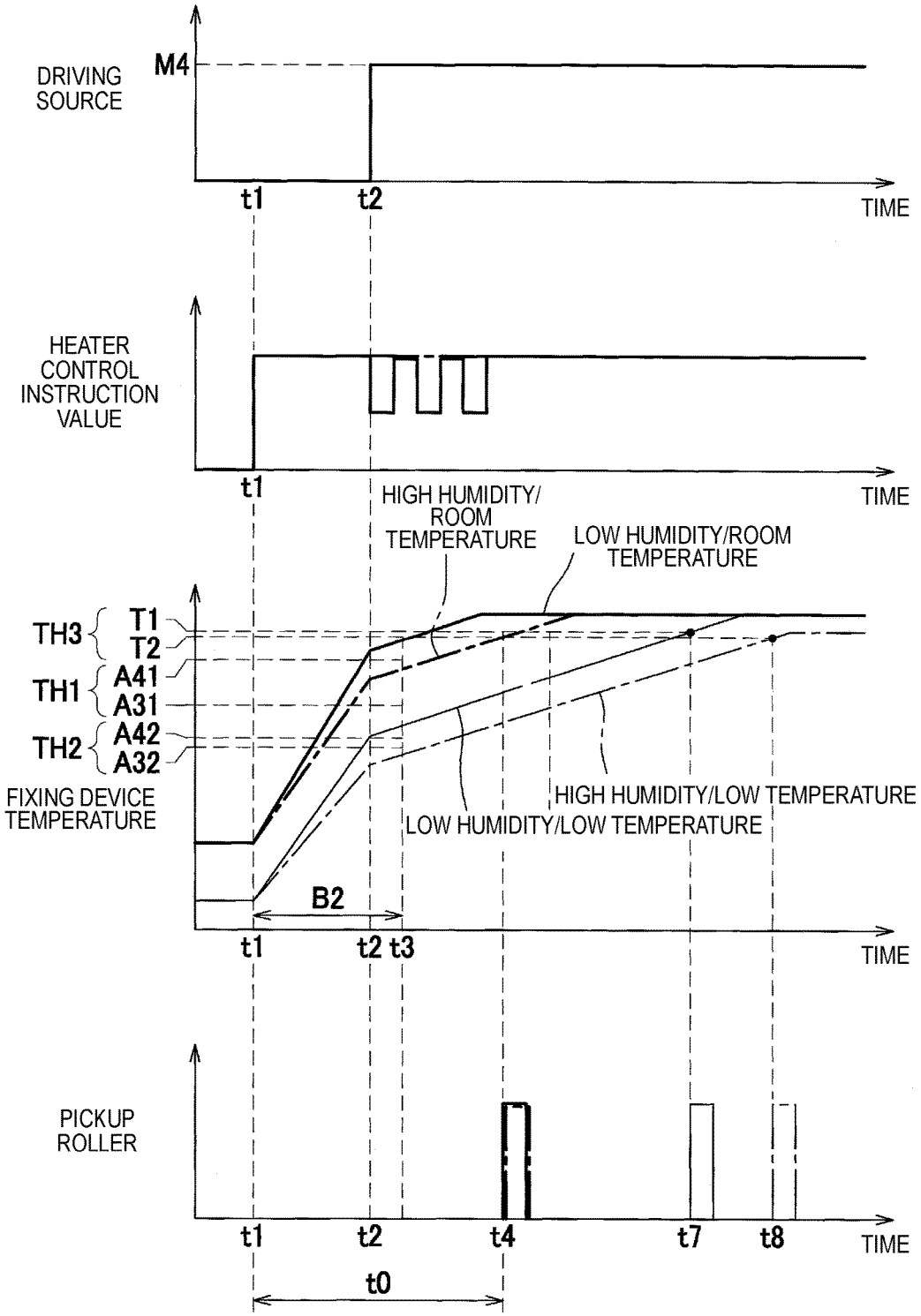
FIG. 8 is a timing chart depicting a difference of the sheet feeding timings depending on humidity.

However, as shown with the thin solid line in FIG. 8, when the laser printer 1 is under low humidity/low temperature environments, the detected temperature $T_{B2}$ of the first thermistor 171 after the second predetermined time B2 from the turn-on of the heater 120 becomes lower than the temperature A41 and higher than the temperature A42. In this case, the control unit 10 sets the predetermined temperature TH3 to the first predetermined temperature T1. Thereby, when the temperature T detected by the first thermistor 171 becomes equal to or higher than the first predetermined temperature T1, the pickup roller 33 rotates to pick up the first sheet P (time t7).

Also, as shown with the thin dashed-dotted line in FIG. 8, when the laser printer 1 is under high humidity/low temperature environments, if the detected temperature $T_{B2}$ of the first thermistor 171 after the second predetermined time B2 from the turn-on of the heater 120 becomes lower than the temperature A31 and the temperature A32, the control unit 10 sets the predetermined temperature TH3 to the second predetermined temperature T2 lower than the first predetermined temperature T1. Thereby, when the temperature T detected by the first thermistor 171 becomes equal to or higher than the second predetermined temperature T2, the pickup roller 33 rotates to pick up the first sheet P (time t8).

Like this, if the temperature of the fixing device 100 is low at the time of receiving the printing command, since the sheet feeding starts when the temperature of the fixing device 100 sufficiently increases, it is possible to promptly start the sheet feeding when the fixing device 100 becomes at an appropriate temperature.

Subsequently, a case where the heat generation state of the heater 120 is different is described with reference to FIG. 9. Meanwhile, regarding the respective conditions shown in FIG. 9, it is assumed that the pressing plate 32 is located at the spaced position at the time of receiving the printing command and the humidity is the same.

When the printing command is received and the heater 120 is thus turned on (time t1), the temperature T detected by the first thermistor 171 starts to increase. At this time, when the heat generation state of the heater 120 is poor (refer to the dashed-dotted line), the temperature T detected by the first thermistor 171 more gently increases, as compared to when the heat generation state of the heater 120 is favorable (refer to the solid line). Thereby, the output of the heater 120 is lower when the heat generation state of the heater 120 is poor, as compared to when the heat generation state of the heater 120 is favorable. Meanwhile, in FIG. 9, when the heat generation state of the heater 120 is favorable, it is denoted as "high heat generation," and when the heat generation state of the heater 120 is poor, it is denoted as "low heat generation."

At the time that the second predetermined time B2 elapses (time t3) after the heater 120 is turned on, when the detected temperature $T_{B2}$ of the first thermistor 171 is not the maximum value Tmax of the temperature T detected by the first thermistor 171 (the heat generation state of the heater 120 is good and the temperature is a room temperature), the control unit 10 sets the first threshold value TH1 to a temperature A51 and the second threshold value TH2 to a temperature A52. Also, at the time that the second predetermined time B2 elapses after the heater 120 is turned on, when the detected temperature $T_{B2}$ of the first thermistor 171 is the maximum value Tmax of the temperature T detected by the first thermistor 171 (when the heat generation state of the heater 120 is good and the temperature is a low temperature and when the heat generation state of the heater 120 is poor), the control unit 10 sets the first threshold value TH to a temperature A61 higher than the temperature A51 and the second threshold value TH2 to a temperature A62 higher than the temperature A52.

At this time, when the detected temperature $T_{B2}$ of the first thermistor 171 is equal to or greater than the first threshold value TH1 (refer to the bold solid line and dashed-dotted line), the pickup roller 33 rotates to pick up the first sheet P (time t4) after the standby time t0 elapses from the turn-on of the heater 120.

Herein, when the heat generation state of the heater 120 is good and the laser printer 1 is used under room temperature environments (refer to the bold solid line), the temperature T detected by the first thermistor 171 after the heater 120 is turned on until the second predetermined time B2 elapses becomes the maximum value Tmax and the fixing device 100 is sufficiently warmed. Therefore, even when the detected temperature TB2 of the first thermistor 171 after the second predetermined time B2 from the turn-on of the heater 120 is a value smaller than the temperature A61, there is a possibility that the fixing device 100 becomes at an appropriate temperature after the standby time to elapses from the turn-on of the heater 120. For this reason, when the detected temperature $T_{B2}$ of the first thermistor 171 after the second predetermined time B2 from the turn-on of the heater 120 is not the maximum value Tmax of the temperature T detected by the first thermistor 171, the first threshold value TH1 is set to the temperature A51 lower than the temperature A61, which is the first threshold value TH1 to be used when the detected temperature $T_{B2}$ of the first thermistor 171 after the second predetermined time B2 from the turn-on of the heater 120 is the maximum value Tmax of the temperature T detected by the first thermistor 171, so that it is possible to promptly start to feed the sheet at appropriate timing at a condition by which the fixing device 100 becomes at an appropriate temperature after the standby time t0 from the turn-on of the heater 120.

However, as shown with the thin solid line in FIG. 7, when the heat generation state of the heater 120 is good but the laser printer 1 is under low temperature environments, the detected temperature $T_{B2}$ of the first thermistor 171 after the second predetermined time B2 from the turn-on of the heater 120 may become lower than the temperature A61 and higher than the temperature A62. In this case, the control unit 10 sets the predetermined temperature TH3 to the first predetermined temperature T1. Thereby, when the temperature T detected by the first thermistor 171 becomes equal to or higher than the first predetermined temperature T1, the pickup roller 33 rotates to pick up the first sheet P (time t9).

Also, as shown with the thin dashed-dotted line in FIG. 7, when the heat generation state of the heater 120 is poor and the laser printer 1 is under low temperature environments, the detected temperature $T_{B2}$ of the first thermistor 171 after the second predetermined time B2 from the turn-on of the heater 120 may become lower than the temperature A51 and the temperature A52. In this case, the control unit 10 sets the predetermined temperature TH3 to the second predetermined temperature T2 higher than the first predetermined temperature T1. Thereby, when the temperature T detected by the first thermistor 171 becomes equal to or higher than the second predetermined temperature T2, the pickup roller 33 rotates to pick up the first sheet P (time t10).

Like this, if the temperature of the fixing device 100 is low at the time of receiving the printing command, since the sheet feeding starts when the temperature of the fixing device 100 sufficiently increases, it is possible to promptly start the sheet feeding when the fixing device 100 becomes at an appropriate temperature.

As described above, according to the illustrative embodiment, since the first threshold value TH1 is changed in correspondence to the output of the heater 120, it is possible to promptly start the sheet feeding at an appropriate timing after the printing command is received while maintaining a fixing quality.

Also, when the pressing plate 32 is located at the sheet feeding position, the first output control of setting the output of the driving source 8 to the third small output M3 is enabled, so that the number of rotations of the developing roller 71, the supply roller 72 and the agitator 75 of the developing unit 7 is reduced, as compared to the laser printer 1 configured to always perform the control by the second output control (of setting the output of the driving source 8 to the fourth output M4). Thereby, it is possible to suppress the toner from being deteriorated.

Although the illustrative embodiment of the disclosure has been described, the disclosure is not limited to the above illustrative embodiment. The specific configuration can be appropriately changed without departing from the gist of the disclosure.

In the above illustrative embodiment, the control unit 10 is configured to control the rotation/stop of the pickup roller 33, thereby controlling the supply timing of the sheet P. However, the method of controlling the supply timing of the sheet P is not limited thereto. For example, the pickup roller 33 may be provided close to or spaced from the pressing plate 32 located at the sheet feeding position and the control unit 10 may be configured to bring the pickup roller 33 close to the pressing plate 32, to bring the pickup roller 33 into contact with the sheet P and to rotate the pickup roller 33 at the supply timing of the sheet P. Also, the control unit 10 may be configured to rotate the pickup roller 33 after receiving the printing command and to bring the pickup roller 33 close to the pressing plate 32 at the supply timing of the sheet P.

In the above illustrative embodiment, the pickup roller 33 has been exemplified as the feeding roller. However, the feeding roller is not limited thereto, and may be the registration rollers 37, for example.

In the above illustrative embodiment, the fixing device 100 having the fixing belt 110 and the nip plate 130 has been exemplified. However, the configuration of the fixing device is not limited thereto. For example, the fixing device may have a heating roller, which is to be heated by the heater, and a pressing roller configured to sandwich and convey the sheet P between the pressing roller and the heating roller. In this case, the temperature sensor may be provided to detect a temperature of the heating roller.

In the above illustrative embodiment, the laser printer 1 has the pressing plate position sensor 32A configured to detect the position of the pressing plate 32. However, the method of determining the position of the pressing plate 32 is not limited thereto. For example, the laser printer 1 may have a pressing plate position estimation unit configured to store the accumulated number of rotations of the driving source 8 in a memory and to estimate the position of the pressing plate 32. In the meantime, the accumulated number of rotations of the driving source 8 stored in the memory is reset as the sheet feeding tray 31 is demounted or mounted. Also, the laser printer 1 may have the pressing plate position sensor 32A and a sheet remaining amount sensor 32B (refer to FIG. 1) configured to detect a position of the sheet P, which is located at the uppermost position, of the sheets P placed on the pressing plate 32, and may be configured to switch the first output control and the second output control on the basis of information from the two sensors.

In the above illustrative embodiment, the control operation of the control unit 10 is executed by the CPU. However, the configuration of the control unit is not limited thereto, and a part thereof may be executed by a logical circuit (digital circuit) such as an FPGA (Field Programmable Gate Array), an ASIC (Application Specific Integrated Circuit), a PGA (Programmable Gain Amplifier) and the like.

What is claimed is:

1. An image forming apparatus comprising:

a fixing device including a heater and a temperature sensor and configured to heat-fix developer on a recording sheet at a fixing region;

a feeding roller configured to feed the recording sheet to the fixing device; and a controller configured to:

turn on the heater when the controller receives a printing command;

determine whether a temperature detected by the temperature sensor is equal to or greater than a first threshold temperature or smaller than the first threshold temperature when the controller receives the printing command;

cause the feeding roller to feed the recording sheet at a first timing, in a case that the temperature detected by the temperature sensor is determined to be equal to or greater than the first threshold temperature;

cause the feeding roller to feed the recording sheet at a second timing later than the first timing, in a case where the temperature detected by the temperature sensor is determined to be smaller than the first threshold temperature;

selectively set the first threshold temperature to a first value or a second value smaller than the first value when the controller receives the printing command;

selectively execute a first control in which the heater is driven by a first output or a second control in which the heater is driven by a second output larger than the first output when the controller receives the printing command;

set the first threshold temperature to the first value, in a case where the first control is executed;

set the first threshold temperature to the second value, in a case where the second control is executed;

cause the feeding roller to feed the recording sheet after waiting for a predetermined time after the heater has started to be driven, in a case where the first control is executed; and cause the feeding roller to feed the recording sheet after the temperature detected by the temperature sensor reaches a predetermined temperature after the heater has started to be driven, in a case where the second control is executed.

2. The image forming apparatus according to claim 1, further comprising a driving source, wherein the fixing device includes a roller configured to convey the recording sheet at the fixing region, wherein the controller is configured to:

cause the driving source to drive the roller of the fixing device by a first rotational speed, in a case where the first control is executed; and cause the driving source to drive the roller of the fixing device by a second rotational speed larger than the first rotational speed, in a case where the second control is executed.

3. The image forming apparatus according to claim 1, wherein the controller is configured to:

determine whether the temperature detected by the temperature sensor is equal to or greater than a second threshold temperature which is smaller than the first threshold temperature or smaller than the second threshold temperature, in a case where the second control is executed;

set the predetermined temperature to a first predetermined temperature, in a case where the temperature detected by the temperature sensor is determined to be equal to or greater than the second threshold temperature; and set the predetermined temperature to a second predetermined temperature smaller than the first predetermined temperature, in a case where the temperature detected by the temperature sensor is determined to be smaller than the second threshold temperature.

4. The image forming apparatus according to claim 1, further comprising a driving source, wherein the fixing device includes a roller configured to convey the recording sheet at the fixing region, wherein the controller is configured to:

selectively execute a first control in which the roller of the fixing device is driven by a first rotational speed or a second control in which the roller of the fixing device is driven by a second rotational speed larger than the first rotational speed when the controller receives the printing command;

set the first threshold temperature to the first value, in a case where the first control is executed; and set the first threshold temperature to the second value, in a case where the second control is executed.

5. The image forming apparatus according to claim 4, further comprising a developing roller configured to carry the developer, wherein the driving source is coupled to the developing roller and is configured to drive the developing roller.

6. The image forming apparatus according to claim 5, further comprising a support plate which is configured to support the recording sheet to be fed to the fixing device by the feeding roller and move between a first position and a second position, wherein the driving source is configured to drive the support plate.

7. The image forming apparatus according to claim 6, wherein the feeding roller includes a pickup roller configured to pick up the recording sheet supported by the support plate, wherein the support plate is configured to move between the first position and the second position which is closer to the pickup roller than the first position, wherein the driving source is configured to drive the support plate from the first position to the second position, and wherein, when the printing command is received, the controller is configured to:

determine whether the support plate is located at the first position or the second position;

execute the second control, in a case where the support plate is determined to be located at the first position; and execute the first control, in a case where the support plate is determined to be located at the second position.

8. An image forming apparatus comprising:

a fixing device including a heater and a temperature sensor and configured to heat-fix developer on a recording sheet at a fixing region;

a feeding roller configured to feed the recording sheet to the fixing device;

a humidity sensor; and a controller configured to:

turn on the heater when the controller receives a printing command;

determine whether a temperature detected by the temperature sensor is equal to or greater than a first threshold temperature or smaller than the first threshold temperature when the controller receives the printing command;

cause the feeding roller to feed the recording sheet at a first timing, in a case that the temperature detected by the temperature sensor is determined to be equal to or greater than the first threshold temperature;

cause the feeding roller to feed the recording sheet at a second timing later than the first timing, in a case where the temperature detected by the temperature sensor is determined to be smaller than the first threshold temperature;

selectively set the first threshold temperature to a first value or a second value smaller than the first value when the controller receives the printing command;

selectively execute a first control in which the heater is driven by a first output or a second control in which the heater is driven by a second output larger than the first output when the controller receives the printing command;

set the first threshold temperature to the first value, in a case where the first control is executed;

set the first threshold temperature to the second value, in a case where the second control is executed;

determine whether a humidity detected by the humidity sensor is equal to or greater than a predetermined value or smaller than the predetermined value when the controller receives the printing command;

execute the second control, in a case where the humidity detected by the humidity sensor is determined to be equal to or greater than the predetermined value; and execute the first control, in a case where the humidity detected by the humidity sensor is determined to be smaller than the predetermined value.

9. An image forming apparatus comprising:

a fixing device including a heater and a temperature sensor and configured to heat-fix developer on a recording sheet at a fixing region;

a feeding roller configured to feed the recording sheet to the fixing device;

a humidity sensor; and a controller configured to:

turn on the heater when the controller receives a printing command;

determine whether a temperature detected by the temperature sensor is equal to or greater than a first threshold temperature or smaller than the first threshold temperature when the controller receives the printing command;

cause the feeding roller to feed the recording sheet at a first timing, in a case that the temperature detected by the temperature sensor is determined to be equal to or greater than the first threshold temperature;

cause the feeding roller to feed the recording sheet at a second timing later than the first timing, in a case where the temperature detected by the temperature sensor is determined to be smaller than the first threshold temperature;

selectively set the first threshold temperature to a first value or a second value smaller than the first value when the controller receives the printing command;

determine whether a humidity detected by the humidity sensor is equal to or greater than a predetermined value or smaller than the predetermined value when the controller receives the printing command;

set the first threshold temperature to the second value, in a case where the controller determines that the humidity detected by the humidity sensor is equal to or greater than the predetermined value; and set the first threshold temperature to the second value, in a case where the controller determines that the humidity detected by the humidity sensor is smaller than the predetermined value.

10. The image forming apparatus according to claim 9, wherein the controller is configured to:

selectively execute a first control in which the heater is driven by a first output or a second control in which the heater is driven by a second output larger than the first output when the controller receives the printing command;

set the first threshold temperature to the first value, in a case where the first control is executed; and set the first threshold temperature to the second value, in a case where the second control is executed.

11. The image forming apparatus according to claim 10, further comprising a driving source, wherein the fixing device includes a roller configured to convey the recording sheet at the fixing region, wherein the controller is configured to:

cause the driving source to drive the roller of the fixing device by a first rotational speed, in a case where the first control is executed; and cause the driving source to drive the roller of the fixing device by a second rotational speed larger than the first rotational speed, in a case where the second control is executed.

12. The image forming apparatus according to claim 10, wherein the controller is configured to:

cause the feeding roller to feed the recording sheet after waiting for a predetermined time after the heater has started to be driven, in a case where the first control is executed, and cause the feeding roller to feed the recording sheet after the temperature detected by the temperature sensor reaches a predetermined temperature after the heater has started to be driven, in a case where the second control is executed.

13. The image forming apparatus according to claim 12, wherein the controller is configured to:

determine whether the temperature detected by the temperature sensor is equal to or greater than a second threshold temperature which is smaller than the first threshold temperature or smaller than the second threshold temperature, in a case where the second control is executed;

set the predetermined temperature to a first predetermined temperature, in a case where the temperature detected by the temperature sensor is determined to be equal to or greater than the second threshold temperature; and set the predetermined temperature to a second predetermined temperature smaller than the first predetermined temperature, in a case where the temperature detected by the temperature sensor is determined to be smaller than the second threshold temperature.

14. The image forming apparatus according to claim 9, further comprising a driving source, wherein the fixing device includes a roller configured to convey the recording sheet at the fixing region, wherein the controller is configured to:

selectively execute a first control in which the roller of the fixing device is driven by a first rotational speed or a second control in which the roller of the fixing device is driven by a second rotational speed larger than the first rotational speed when the controller receives the printing command;

set the first threshold temperature to the first value, in a case where the first control is executed; and set the first threshold temperature to the second value, in a case where the second control is executed.

15. The image forming apparatus according to claim 14, further comprising a developing roller configured to carry the developer, wherein the driving source is coupled to the developing roller and is configured to drive the developing roller.

16. The image forming apparatus according to claim 15, further comprising a support plate which is configured to support the recording sheet to be fed to the fixing device by the feeding roller and move between a first position and a second position, wherein the driving source is configured to drive the support plate.

17. The image forming apparatus according to claim 16, wherein the feeding roller includes a pickup roller configured to pick up the recording sheet supported by the support plate, wherein the support plate is configured to move between the first position and the second position which is closer to the pickup roller than the first position, wherein the driving source is configured to drive the support plate from the first position to the second position, and wherein, when the printing command is received, the controller is configured to:

determine whether the support plate is located at the first position or the second position;

execute the second control, in a case where the support plate is determined to be located at the first position; and execute the first control, in a case where the support plate is determined to be located at the second position.

* * * * *